US006620044B1

(12) United States Patent
Okada

(10) Patent No.: US 6,620,044 B1
(45) Date of Patent: Sep. 16, 2003

(54) GAMING MACHINE

(75) Inventor: Kazuo Okada, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/241,363

(22) Filed: Jan. 29, 1999

(30) Foreign Application Priority Data

Jan. 30, 1998 (JP) ..... 10-019635

(51) Int. Cl.[7] ..... A63F 9/24
(52) U.S. Cl. ..... 463/20; 273/143 R
(58) Field of Search ..... 463/20, 16; 273/143 R

(56) References Cited

U.S. PATENT DOCUMENTS

| | | | | | |
|---|---|---|---|---|---|
| 5,560,603 | A | * | 10/1996 | Seelig et al. | 463/6 |
| 5,664,999 | A | * | 9/1997 | Kurihara | 463/20 |
| 5,722,891 | A | * | 3/1998 | Inoue | 463/20 |
| 5,779,544 | A | * | 7/1998 | Seelig et al. | 463/6 |
| 5,882,261 | A | * | 3/1999 | Adams | 463/20 |
| 5,919,088 | A | * | 7/1999 | Weiss | 463/20 |
| 5,934,672 | A | * | 8/1999 | Sines et al. | 273/143 R |
| 5,997,400 | A | * | 12/1999 | Seelig et al. | 463/6 |
| 6,106,393 | A | * | 8/2000 | Sunaga et al. | 463/20 |
| 6,113,493 | A | * | 9/2000 | Walker et al. | 463/25 |
| 6,135,884 | A | * | 10/2000 | Hedrick et al. | 463/20 |
| 6,174,233 | B1 | * | 1/2001 | Sunaga et al. | 463/20 |
| 6,287,194 | B1 | * | 9/2001 | Okada et al. | 463/16 |

* cited by examiner

*Primary Examiner*—Michael O'Neill
*Assistant Examiner*—Julie Brocketti
(74) *Attorney, Agent, or Firm*—Rohm & Monsanto, PLC

(57) ABSTRACT

A gaming machine is provided with a variable display for displaying principal graphical information corresponding to at least one of a plurality of principal graphical elements, each principal graphical element having a predetermined significance in a principal game of the gaming machine. A secondary display displays secondary graphical information and is provided with a display portion positioned below the display portion of the variable display. A controller produces first control signals that control the variable display to display the principal graphical information as a sequential principal progression of the principal graphical elements, and second control signals that control the secondary display to display the secondary graphical information. The secondary graphical information has a predetermined relationship to the sequential progression of the principal graphical elements. During the period of variation of the symbols in the variable display, a separate indication that is correlated to the control of the variation action of the variable display is performed by the secondary display. As a result, player monotony while waiting for the result of the game is greatly reduced. The display portion of the secondary display is provided below the display portion of the variable display. Therefore, a player can watch the separate indication of the secondary display and the indication of the variable display substantially simultaneously over an extended period of time without fatigue.

5 Claims, 12 Drawing Sheets

| 7 | BAR | | | LOSS |
|---|---|---|---|---|
| 20 | 50 | 15 | 30 | 40 |

GAMING MACHINE

BACKGROUND OF THE INVENTION

1. Field of the Invention

This invention relates generally to gaming machines, and more particularly to gaming machines such as slot machines or the like that have a variable display for displaying image information representative of a plurality of symbols necessary for a game and a controller such as a microcomputer for controlling the variation action of the variable display.

2. Description of the Related Art

A gaming machine such as a slot machine usually has a mechanical variable display formed of rotatable display elements that are provided with a plurality of symbols disposed on peripheral surfaces thereof. The symbols are visible through a display window at the front of the slot machine. Alternatively, an electrical variable display is formed of indicating elements with symbols on a display screen. In response to a "start" operation by a player, a controller drives the variable display to start the rotation of each rotatable display element and to stop the rotation of each rotatable display element in a determined sequence automatically after a predetermined period of time has elapsed, or in response to initiation of a "stop" operation by the player. When the rotation of all of the rotatable display elements has ceased, there is shown a specific combination of symbols (winning pattern) in the display window. The player is then given an award by paying out gaming medium such as coins. In a recent popular model of a gaming machine, a "win" corresponding to a predetermined plurality of winning symbols being completely positioned on the effective line of the display when rotation of the rotatable display elements ceases occurs only when a win has been established by a system internal to the gaming machine. In a practical machine, this happens when a sampling operation of a random number issued by a microcomputer has been determined to constitute a win.

The reason why such gaming machines have become popular is that if the particular symbols that appear on the display when the rotatable display elements are stopped were to depend completely on the stop operation, or timing, of the player, the end result (i.e., win or loss) of the game would be responsive to the skill of the player. Consequently, only the relative abilities of the players would be emphasized, and the wholesomeness of the game would be compromised. A further reason for the popularity of such machines is that their designers have solved a number of problems related to management of the pay out rate of the coins for amusement shops.

In such known gaming machines, a microcomputer decides which symbols are to be displayed when the display variation ceases, and controls the stopping of the variation action to display the predetermined symbols. It is often difficult for the player to wait for symbols to be displayed when the variation in the display stops, and until such time, the player merely waits to obtain the result. There is a need, therefore, for a gaming machine that overcomes the known problems relating to obtaining the winning indication from the display.

In one effort at alleviating these problems, for example, there is disclosed in Japanese Patent Application Kokai (Laid-Open) No. 8-206328 a gaming machine that is provided with a game indication device that operates in response to the occurrence of a predetermined winning condition. When a winning condition occurs on this game indication device, the gaming machine is itself caused to assume a winning condition. With such gaming machine, the player can enjoy a "big hit" for a period of time while the "big hit" condition is completed. Moreover, the probability of occurrence of a hit is increased. This known arrangement, however, is operated for the duration of the winning condition of the gaming machine. This means that the game indication device does not work till a result of the game performed by the gaming machine itself is obtained. Therefore, the gaming machine is not different from the conventional gaming machine in that the player must wait over a period from beginning of the game to the time when the result of the game is obtained.

Further, there is disclosed in Japanese Patent Application Kokai (Laid-Open) No. 8-10385 slot machine that is provided with a second display unit in addition to the main variable display for displaying a plurality of symbols. In this slot machine, a game in the second display unit is performed in determined time (service time) when a game can be performed without coin insertion by interrupt control. Also, the game of the second display unit is performed during the service time and occurs after the completion of the usual game. This means that the second display does not operate when the main display for performing the original game of slot machine is working.

Therefore, this further known gaming machine does not solve the problems discussed above with respect to certain conventional gaming machines in that the player has to wait from beginning of the game to the time when the result of the game is obtained. Thus, in conventional gaming machines, if a further display device is provided in addition to the variable display, the player merely watches signals varying on the variable display over the duration of the main game.

SUMMARY OF THE INVENTION

An object of this invention is to provide a gaming machine that prevents a player from becoming bored due to the monotonous action of the variable display while waiting for the result of the game on a variable display. This is achieved by presenting indications on a separate display during the period of the game that is being performed on the variable display in the form of image information that is representative of a plurality of symbols necessary for the playing of the game. The separate display is disposed so as to be easily viewed by a player who desires to pay attention to the variable display.

In accordance with the invention, a gaming machine is provided with a variable display for displaying principal graphical information corresponding to at least one of a plurality of principal graphical elements; each principal graphical element having a predetermined significance in a principal game of the gaming machine; a secondary display for displaying secondary graphical information having a display portion positioned below the display portion of the variable display; and a controller for producing a first control signal that controls the variable display to display the principal graphical information as a sequential progression of the principal graphical elements, and a second control signal to control the secondary display to display the secondary graphical information corresponding to a result of the principal game.

The controller controls variation action of the variable display during the gaming period. The result of the game, that is, the indication of "win" or "loss," appears depending upon the particular symbols that are shown when the variation action has stopped. The variable display is controlled by the controller to determine the symbols that are to be shown when the variation of symbols in the variable display is stopped in response to the game result, and also to stop the variation so as to show the determined symbols to the player. An image that is determined by the controller is displayed on the secondary display, which may be different from the variable display. Consequently, a player, by viewing the secondary display, can predict or expect a result of the game during the variation of symbols, i.e., before the variable display is stopped.

The image that is determined in response to the control of the variable display may include indication of control states corresponding to a type of game result (such as win or loss, kinds of wins, etc.) determined by the controller. In addition, the determined image may include a game display that is necessary for performing individual or separate games from that being played on the variable display. Such a determination of the images is performed by the controller. In embodiments where the secondary display includes a display control unit to determine the displayed image in response to a command from the controller, the determination of the images is performed by the display control unit.

Since the player must pay attention to the variation of the variable display and watch the separate indication on the secondary display, the variable display and the separate indication are preferably included in the field of the player's vision. In one embodiment, the display position of the secondary display is disposed below the display position of the variable display. Therefore, the player can see the display of the secondary display by moving his eyes only a small distance from the variable display. Moreover, the lower position of the secondary display captures the attention of the player. The player can easily watch the separate display while simultaneously paying attention to the indication of the variable display.

The secondary display may include electric displays such as liquid crystal, CRT, and LED, as well as mechanical displays having rotating display elements of structure as are used in conventional slot machines. The images displayed by the secondary display may be distinguished from each other by using various kinds of characters and figures, animations, lights flashing on and off, and the like. The images for the secondary display can be classified into several kinds, such as "prognostic" images, that lead the player to believe that a particular display, such as a "big hit," is to occur, images indicating promotion of a "big hit," images indicating a "big hit," images indicating a "loss," images giving expectation for a "big hit" to the player. For example, the memory of a microcomputer can store such images as data.

In accordance with one embodiment of this invention, the variable display has a plurality of movable display units disposed parallel side-by-side, the secondary display being provided below the display position of a specified movable display unit that is controlled by the controller to stop last.

Because the secondary display is provided below the display position of a specified movable display unit that is controlled to stop last, and therefore, the player easily see the indication of the secondary display without moving his eyes from the moving indication of the movable display unit. Furthermore, since the images indicated are within the field of the player's vision, the player can recognize the connection or corresponding relationship between the images and the results obtained when the variable display stops.

In accordance with another embodiment of the invention, the variable display is controlled so that a movable display unit in the middle position is stopped last and the secondary display is disposed below the middle movable display unit.

Among the plurality of movable display units disposed parallel side-by-side, the movable display unit of the middle position is controlled to stop last, and the secondary display is provided immediately below the movable display unit of the middle position. As a result, when it appears that a state is reached where a winning pattern can be obtained if one more special symbol may be displayed, even it the player looks to the left or to the right, the images displayed in the middle position are within the field of the player's vision, easily attracting the player's attention. Furthermore, since the secondary indication is disposed in the middle position, the player easily can see the indication and therefore, large movement of the eyes is not required, resulting in reduced fatigue.

In accordance with another embodiment of the invention, the controller is arranged to produce the second control signal in response to the principal graphical information representing the result of the principal game, selects the specified secondary graphical information corresponding to the second control signal, and controls the secondary display to display the specified secondary graphical information.

In accordance with yet another embodiment of the invention, the secondary graphical information has a predetermined significance in a secondary game shown in the secondary display. The controller produces the second control signal in response to the principal graphical information representing the result of the principal game, selects the specified secondary graphical information corresponding to the second control signals, and controls the secondary display to play the secondary game.

BRIEF DESCRIPTION OF THE DRAWING

The foregoing and other objects, features, and advantages of the invention will become more apparent from the following detailed description taken in conjunction with the accompanying drawings, in which.

DETAILED DESCRIPTION

Figure 1:
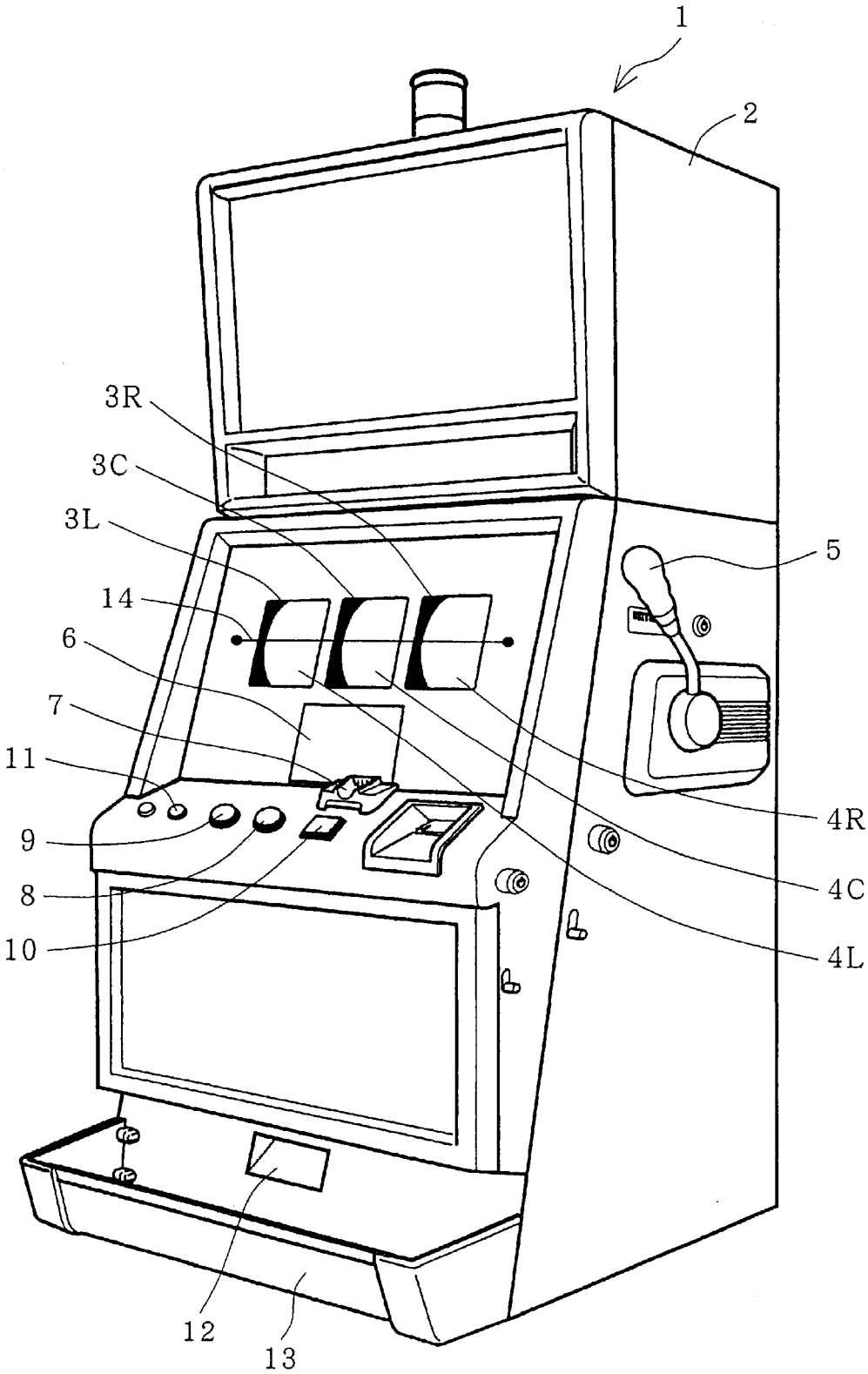
FIG. 1 is an isometric representation of a specific illustrative embodiment of the invention in the form of a slot machine.

FIG. 1 is an isometric representation of a specific illustrative embodiment of the invention in the form of a slot machine 1. Slot machine 1 is a gaming machine played using a coin, a medal or a token (not shown), and the like as game media. Hereinafter, the game media will be referred to as "medal".

On the front face of a cabinet 2 forming a housing for slot machine 1, three display windows 3L, 3C, and 3R are arranged in a horizontal line. Additionally, various kinds of symbols (not shown in this figure) are displayed on central winning line 14 or its upper and lower positions of each display window, as will be described hereinbelow with respect to FIG. 6. These symbols are drawn on the surface of the sheet forming circumferential surfaces of three rotatable display elements 4L, 4C, and 4R which are arranged inside of cabinet 2 in correspondence to display windows 3L, 3C, and 3R. A mechanically variable display is formed of these rotatable display elements. On the side surface of cabinet 2 is provided a start lever 5 for rotating the rotatable display elements in response to actuation by a player (not shown). Lever 5 is arcuately displaceable within a predetermined range of angular motion. Further, a liquid crystal display 6 is arranged to display information, as will be described hereinbelow, and is shown to be located at lower center of the display windows of the front face of cabinet 2. The images displayed therein, as well as their function in the course of playing the game of the present invention, will be described in detail later.

Below liquid crystal display 6, there are disposed a medal entry slot 7 where medals of game media are inserted, a spin switch 8 for starting the rotatable display elements mentioned above by button-pushing operation as an alternative to the actuation of start lever 5, a 1-BET switch 9 for betting only one medal credited on a game to allow a one-time button-pushing operation, a maximum BET switch 10 for betting maximum numbers of medals that can be bet on one time of game, and a C/P switch 11 for changing credit/payout of medals acquired by the player as a result of the button-pushing operations. Beneath the front face of cabinet 2 there is provided a medal tray 13 for saving medals paid out via a medal chute 12 in response to the actuation of C/P switch 11.

Figure 2:
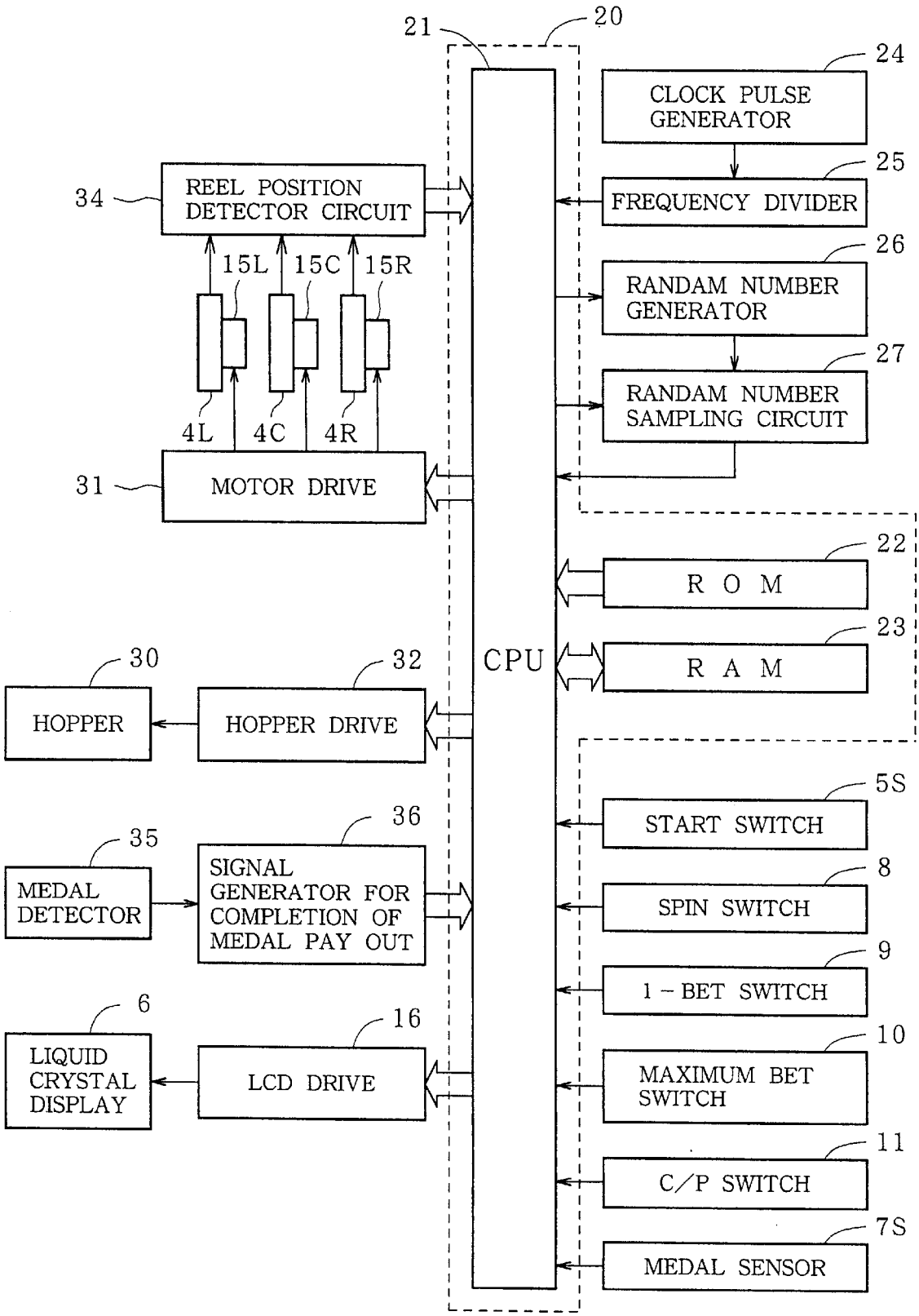
FIG. 2 is a function block diagram that illustrates the arrangement of a circuit used in the slot machine of FIG. 1.

FIG. 2 is a function block diagram that illustrates the methodology and arrangement of logic circuitry (not shown) that contains controllers for controlling the game procedure operations for slot machine 1, and peripheral equipment, i.e., actuators that are electrically connected thereto.

In this specific illustrative embodiment of the invention, control is effected by a microcomputer 20 and a random number sampling circuit 27 is coupled thereto. Microcomputer 20 includes a CPU 21 that executes control operations according to a preset program, and a ROM 22 and a RAM 23 as system memory. CPU 21 has connected thereto a clock pulse generator 24 for generating a reference clock pulse, a frequency divider 25, a random number generator 26 for generating random numbers to be sampled, and previously mentioned random number sampling circuit 27. The random number sampling may be executed in microcomputer 20, i.e., in an operation program of CPU 21. In such a case, random number generator 26 and random number sampling circuit 27 either would not be provided as discrete systems, or they would be used to backup the random number sampling operation.

In ROM 22 of microcomputer 20, in addition to the game control system for the slot machine, there are stored information and data necessary for executing procedures to indicate plural numbers of display images described later on the screen of liquid crystal display 6.

In FIG. 2, the operations are controlled by control signals from microcomputer 20. Stepping motors 15L, 15C, and 15R function as the main actuators for driving each of rotatable display elements 4L, 4C, and 4R mentioned above into rotation. A hopper 30 with a hopper drive 32 is provided for pay out. The hopper accommodates medals of game media. There is additionally provided the above-mentioned liquid crystal display 6 which is operated via a LCD drive 16. These subsystems are each connected to the outputs of CPU 21, and receive control signals therefrom.

Furthermore, the input signals necessary for microcomputer 20 to generate control signals are provided by medal sensor 7S that detects medals (not shown) that are inserted into medal entry slot 7. A start switch 5S detects the operations of start lever 5. Spin switch 8, 1-BET switch 9, maximum BET switch 10, C/P switch 11, rotatable display element position detector circuit 34 for receiving pulse signals from the rotatable display element rotation detector of the variable display and supplying signals for detecting the position of each rotatable display element to CPU 21, and signal generator 36 for completion of medal pay out supply signals to CPU 21 when the counted value of medal detector 35 for detecting medals paid out from hopper 30 reaches the predetermined number. These subsystems are connected to respective inputs of CPU 21.

In FIG. 2, random number generator 26 generates random numbers in a predetermined range of numerical values, and sampling circuit 27 samples one random number within a predetermined time period after start lever 5 has been operated. The random number thus sampled is evaluated to determine whether it pertains to the predetermined winning area stored in the memory portion of ROM 22, and if it does pertain to the winning area, a "winning request signal" is generated.

After rotatable display elements 4L, 4C, and 4R have been driven into rotation, the number of driving pulses supplied to each of stepping motors 15L, 15C, and 15R is counted, and the counted value is written in a predetermined area (not shown) within RAM 23. A reset pulse is delivered from rotatable display elements 4L, 4C, and 4R during every rotation, and these pulses are provided to CPU 21 via rotatable display element (reel) position detector circuit 34. CPU 21 clears the counted value of the driving pulses stored in RAM 23 to "0" by a reset pulse delivered in this manner. Thus, the counted value corresponding to a rotation position in a range of one rotation with respect to each of rotatable display elements 4L, 4C, and 4R is stored within RAM 23.

A symbol table (not shown) is stored within ROM 22 and contains the rotation positions of rotatable display elements 4L, 4C, and 4R, and the symbols (not shown in this figure) are correlated to such rotational positions. In addition, a winning symbol combination table is stored within ROM 22. In this winning symbol combination table are stored data corresponding to the winning symbol combinations, the numbers of medals of dividend for winnings, and the winning determination codes that represent the winnings. The winning symbol combination table is accessed when control over rotatable display elements 4L,4C, and 4R is being executed, and the winning confirmation is executed after all rotatable display elements have been stopped.

In addition, within ROM 22, there are stored a program for executing the procedures to display "routine pattern" described hereinafter on liquid crystal display 6 before a "winning request signal" is generated and to display a "demonstration pattern" after a "winning request signal" is generated; the data of plural display images containing routine patterns and demonstration patterns; and the data that shows the references for selecting the image that should be displayed out of these.

Figure 3:
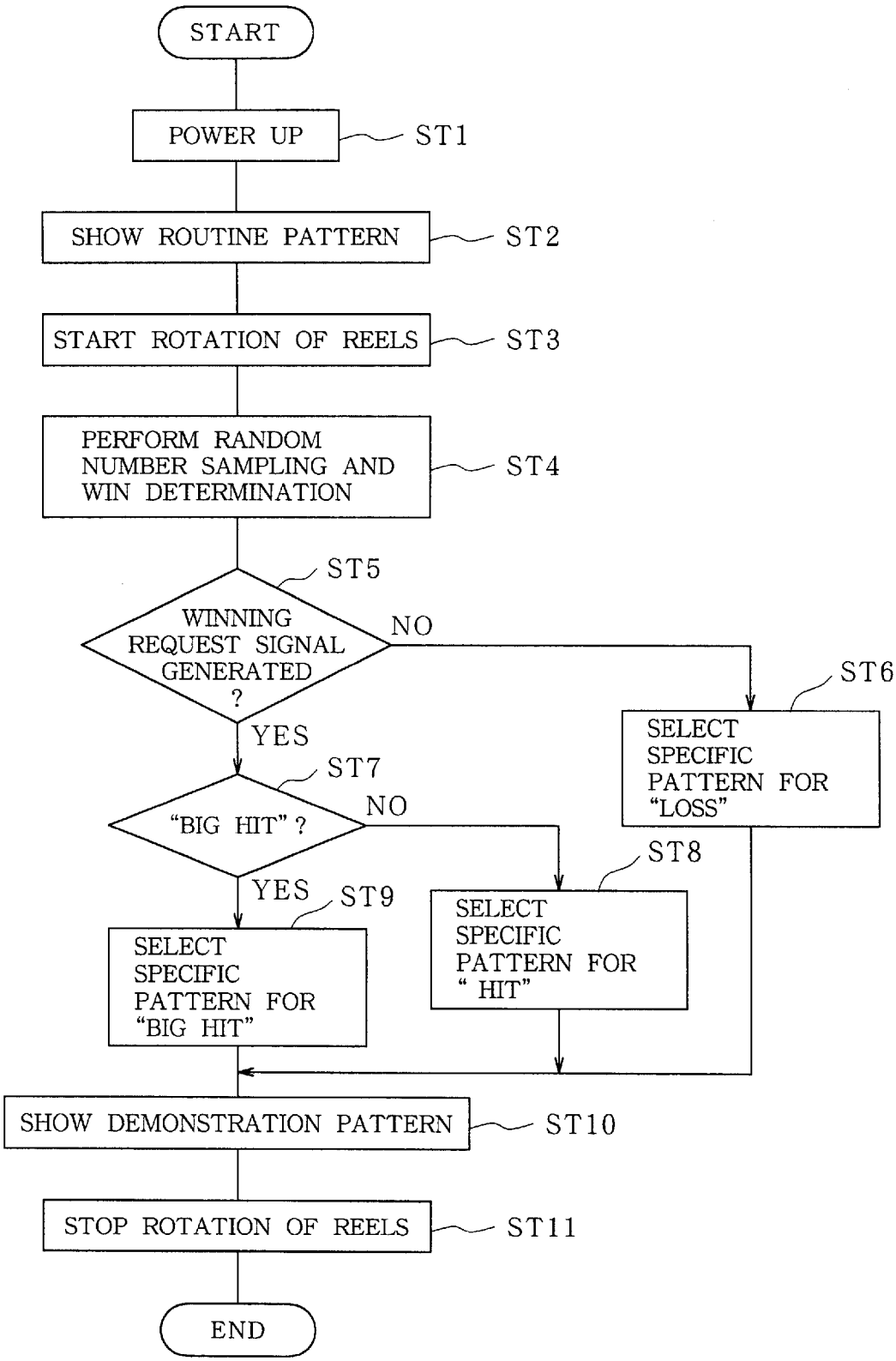
FIG. 3 is a flow chart that illustrates a portion of the control operation of the embodiment of this invention.

FIG. 3 is a flow diagram that illustrates a procedure for the operation that controls liquid crystal display 6. This procedure is executed by CPU 21 of microcomputer 20, which also functions as the game controller of slot machine 1. However, when the display, as does liquid crystal display 6, is provided with a CPU as a display controller, such a CPU may be used to determine the display image according to the display command from CPU 21 (e.g., the display command corresponding to the type of winnings or losses).

Referring to FIG. 3, in the beginning when the power supply of the gaming machine (slot machine 1) is powered up (ST1), the CPU causes liquid crystal display 6 to show a "routine pattern" (ST2). When the player (not shown) operates start lever 5 or spin switch g after inserting medals into medal entry slot 7; or operating 1-BET switch 9; or operating maximum BET switch 10; rotatable display elements 4L, 4C, and 4R are caused to rotate, and the variable display is started (ST3). At this time, the determination of winning/not winning is executed based on the random number extracted by random number sampling (ST4). It is then determined whether or not a "winning request signal" is generated (ST5), and the display image is determined according to the result of the determination. In other words, if a "winning request signal" is not generated, the specific demonstration pattern is selected out of the demonstration pattern group for "loss" (ST6). When a "winning request signal" is generated, it is determined at step (ST7) whether or not the "winning request signal" corresponds to a "big hit."

If the determination is "NO," the specific demonstration pattern for "small hit" is selected out of the demonstration pattern group for "small hit" (ST8). If it is "YES," the specific demonstration pattern for the "big hit" is selected out of the demonstration pattern group for the "big hit" (ST9). The demonstration pattern group (i.e., the demonstration pattern group for "loss," the demonstration pattern group for "hit," and the demonstration pattern group for "big hit") is formed by plural demonstration patterns respectively, and stored within ROM 22. Liquid crystal display 6 indicates the selected pattern in step (ST10), and executes the stop control corresponding to the winning request signals with regard to rotatable display elements 4L, 4C, and 4R during the rotation (ST11). The process then terminates at END.

In the procedure mentioned above, the variable display of ST3 is effected by CPU 21 supplying driving signals to motor drive 31, thereby driving stepping motors 15L, 15C, and 15R, and rotating rotatable display elements 4L, 4C, and 4R. In addition, the winning determination of ST4 is realized by a random number that, as stated, is sampled from random number generator 26 and the value of the random number thus extracted is evaluated to determine the group to which it belongs, as set forth above, in the winning probability table. Then, if the number was determined to be a winning number, CPU 21 delivers signals for controlling to stop rotatable display elements 4L, 4C, and 4R as the symbol display positions that corresponding to the kind of winnings, to motor drive 31. Control over stopping at step ST11 is thus realized.

CPU 21 executes an operation to deliver rotatable display element stop control signals based on the winning determination mentioned above to motor drive 31, and an operation to deliver pattern display signals based on the selection of the "demonstration pattern" that will be presented on liquid crystal display 6, to LCD drive 16 simultaneously. Therefore, while the rotatable display elements (reels) are controlled to stop, the demonstration patterns are displayed on liquid crystal display 6. The "demonstration pattern" will be described in detail later.

When the number is determined to be a winning number, CPU 21 supplies medal pay out command signals corresponding to the kind of winnings to hopper drive 32, and executes the pay out of predetermined numbers of medals from hopper 30. At that time, medal detector 35 counts the number of medals paid out from hopper 30, and when the counted value reaches the predetermined number data, the signal generator for completion of medal pay out 36 inputs signals for completion of medal pay out into CPU 21. CPU 21 stops the drive of hopper 30 via hopper drive 32, thereby completing the procedure of paying out medals.

As described above, in slot machine 1, the CPU determines the generation of a "winning request signal," and executes the stop control of rotatable display elements 4L, 4C, and 4R so that the predetermined symbols of the "big hit" or the "small hit" are stopped on the winning line, or the symbols of "loss" stand in line according to the result. In addition, it controls liquid crystal display 6 to indicate demonstration patterns whereby players can expect the generation of "big hit," "small hit" or "loss."

On the other hand, when liquid crystal display 6 itself possesses a CPU as a display controller, CPU 21, as the game controller, delivers a command to have liquid crystal display 6 indicate the demonstration patterns whereby players can expect the generation of "big hit," "small hit" or "loss" to CPU of liquid crystal display 6, when it executes the rotatable display element stop control as mentioned above. According to this, CPU of liquid crystal display 6 determines the display image, and indicates it on the screen.

Next, the "routine pattern" and the "demonstration pattern" displayed on the screen of the liquid crystal display 6 are explained with reference to examples.

Figure 6:
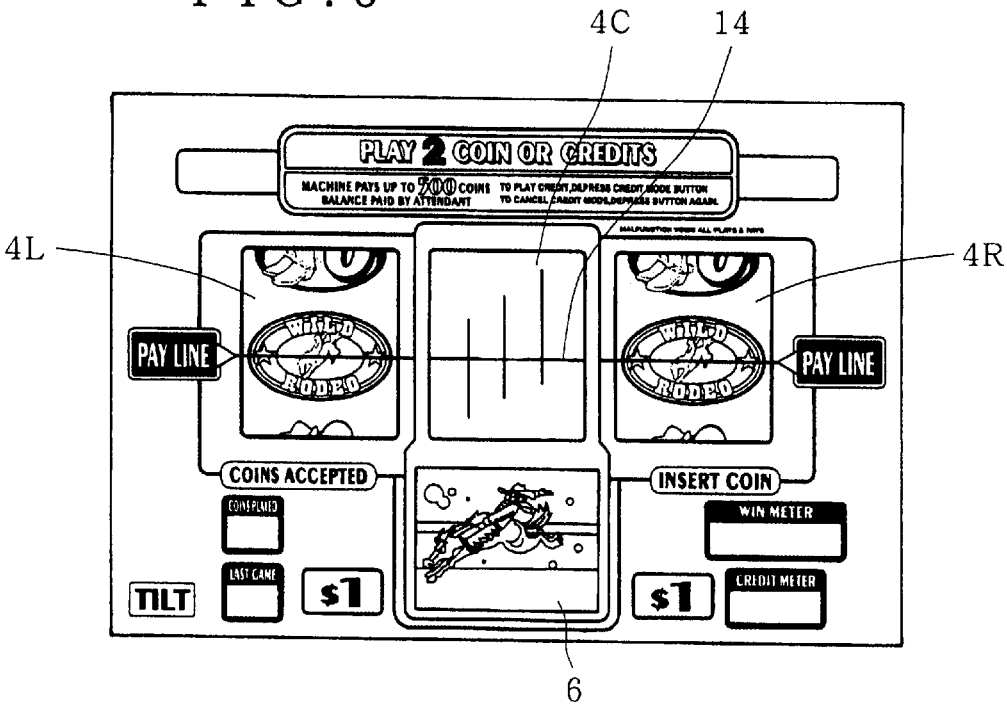
FIG. 6 is a representation that illustrates a reach state of the variable display and a display image indicated at the same time by the liquid crystal display.

FIG. 6 represents a display state in display windows 3L, 3C, and 3R before reels 4L, 4C, and 4R start to rotate, and an example of display images of liquid crystal display 6. "The title of the game" is an example of a routine pattern that is displayed on liquid crystal display 6. As other routine patterns, there are provided displays of "the explanation of the game" or "the explanation when a 'reach' is generated". When the routine pattern has these plural images, they may be indicated one by one at a certain interval.

Figure 5:
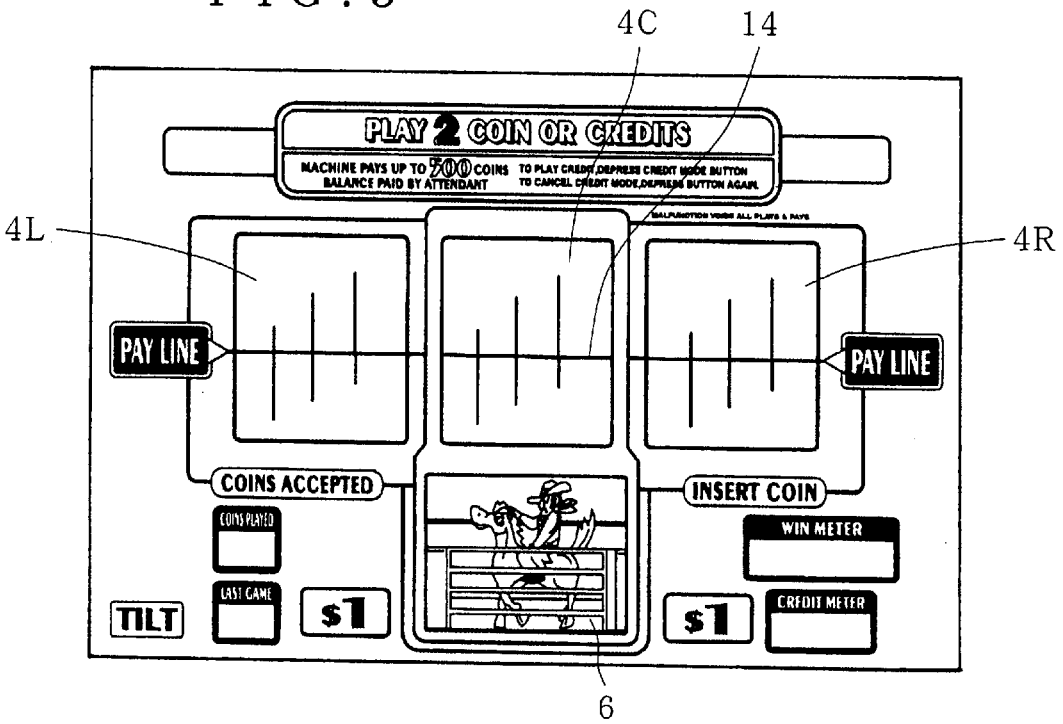
FIG. 5 is a representation that illustrates a display state after the variable display has started and a display image of the liquid crystal display.

FIGS. 5 to 8 represent examples of "demonstration pattern" displayed one-by-one in liquid crystal display 6. In liquid crystal display 6, just after reels 4L, 4C, and 4R have started the rotation, "a cowboy sitting astride a horse," as shown in FIG. 5, appears.

At this time, a demonstration showing the start of the game may be performed by changing the color of the background without disappearance of the routine pattern of the liquid crystal display 6 just after the rotation of reels 4L, 4C, and 4R has started. Also, after the rotation of reels 4L, 4C, and 4R has started, during the predetermined time before the display of demonstration patterns is commenced on liquid crystal display 6, no image appears on liquid crystal display 6, thereby producing a demonstration effect that enhances the feeling of tension in the player at the beginning of the game.

Thereafter, as shown in FIG. 6, when there is generated a state (reach) where a special winning symbol (symbol of "WILD RODEO" in FIG. 6) is displayed upon the stop of rotation of left and right reels 4L, 4R, the image displayed in liquid crystal display 6 is an image showing a state of "a cowboy is fighting with an unruly horse."

Figure 7:
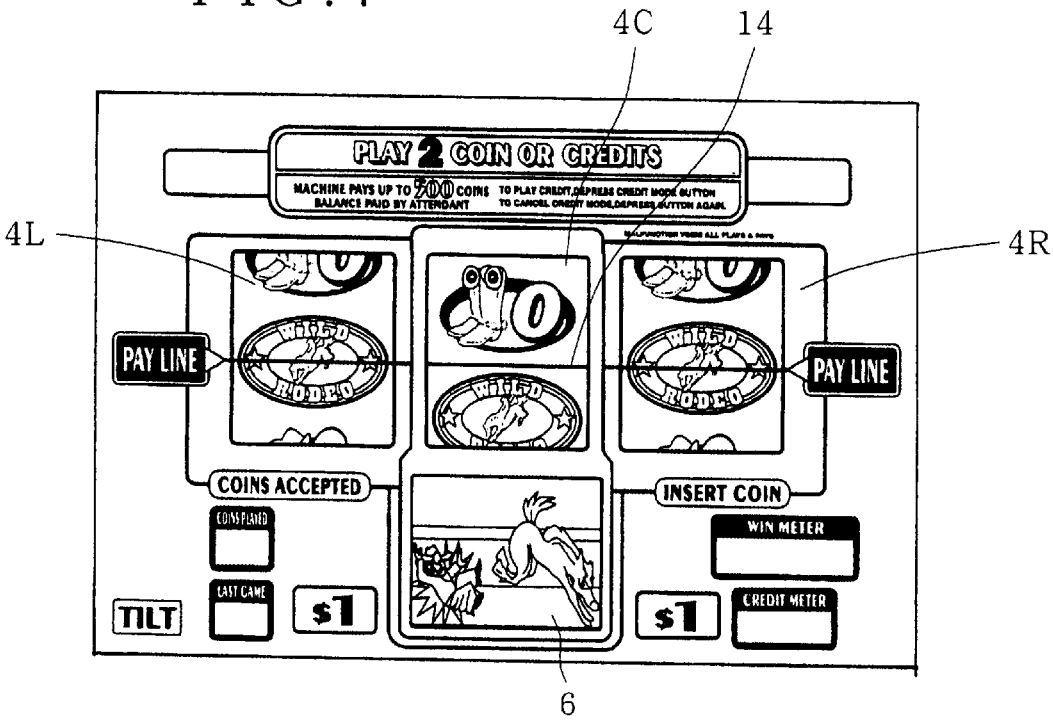
FIG. 7 is a representation that illustrates symbols indicated by the variable display stopped that mean "loss" and a display image indicated at the same time by of the liquid crystal display.
Figure 8:
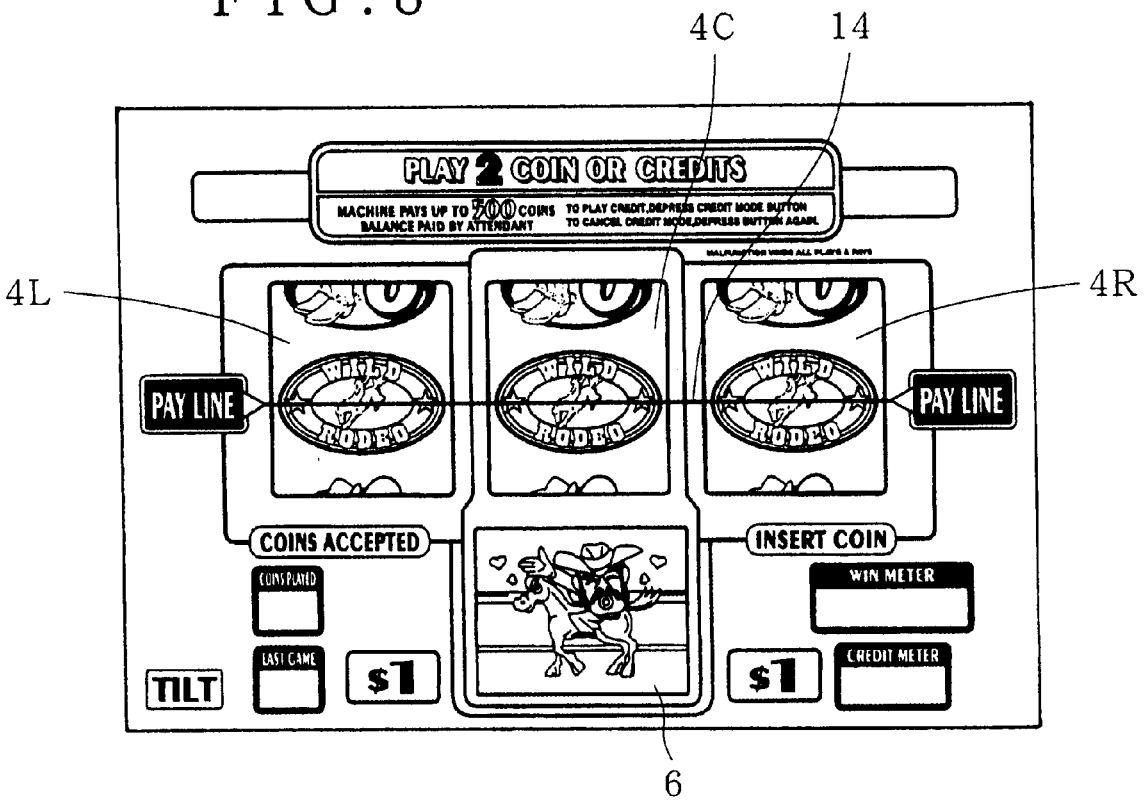
FIG. 8 is a representation that illustrates symbols presented by the stopped variable display that mean "big hit" and a display image that is simultaneously indicated by the liquid crystal display.

Thereafter, as shown in FIG. 7, in the case where a special winning pattern (combination of symbols) is not obtained as a display when the middle reel is stopped, the image on liquid crystal display 6 shows a state of "the cowboy was shaken from a horse," thereby the player misses a win.

In an alternative situation where a special winning pattern (a state where three "WILD RODEO" symbols are arranged in FIG. 8) is obtained when all reels are stopped, the image on liquid crystal display 6 shows a state of "a cowboy rides on a horse with a pose of victory," and consequently the player gains a profit corresponding to the win.

Because the above-mentioned demonstration pattern is indicated as an animation on the screen of liquid crystal display 6, the player feels that he can obtain a win if the cowboy is not shaken from the unruly horse. Therefore the player hopes that the cowboy shall not shaken from the unruly horse while he looks at the screen of liquid crystal display 6 until every reel stops. When the cowboy is shaken from an unruly horse at last, the player experiences the loss. Thus, the player views the demonstration pattern appeared on the screen of liquid crystal display 6 with an expectation as to the result of the game to play game, thereby maintaining a feeling of tension. As a result, a higher level of interest is maintained in the game.

In FIGS. 4 to 8, liquid crystal display 6 is provided below middle reel 4C. As shown in FIG. 6, after the left and right reels are stopped to show a display state (reach) where a special winning pattern of "WILD RODEO" is arranged at each of the left and right positions in the display window, the player has recognized the left and right stop symbols and therefore, the player will pay attention at this time only to the display of middle reel 4C. The player can simultaneously see the display of middle reel 4C and the display image of liquid crystal display 6 disposed below middle reel 4C without moving his eyes to the left or right. As a result, the player can play the game without reducing his concentration on the principal game. In addition, the player is not fatigued, since only a slight movement of the eyes is required. Furthermore, since it is easier for the player who pays attention to the display in the display window to move his eyes downward than upward, so his attention is attracted to the display image. The player pays attention to the display of the middle reel 4C while watching the screen of liquid crystal display 6 while helping the cowboy will not be shaken off of the unruly horse on the time of reach. When middle reel 4C is then stopped, the game result displayed by the display window and image corresponding to the game result are flashed into the field of the player's vision from the middle reel and from the liquid crystal display positioned below the middle reel at the same time. Thus, a corresponding relation or sense of unity between the game result of the display window and image displayed in the liquid crystal display can be produced.

Figure 4:
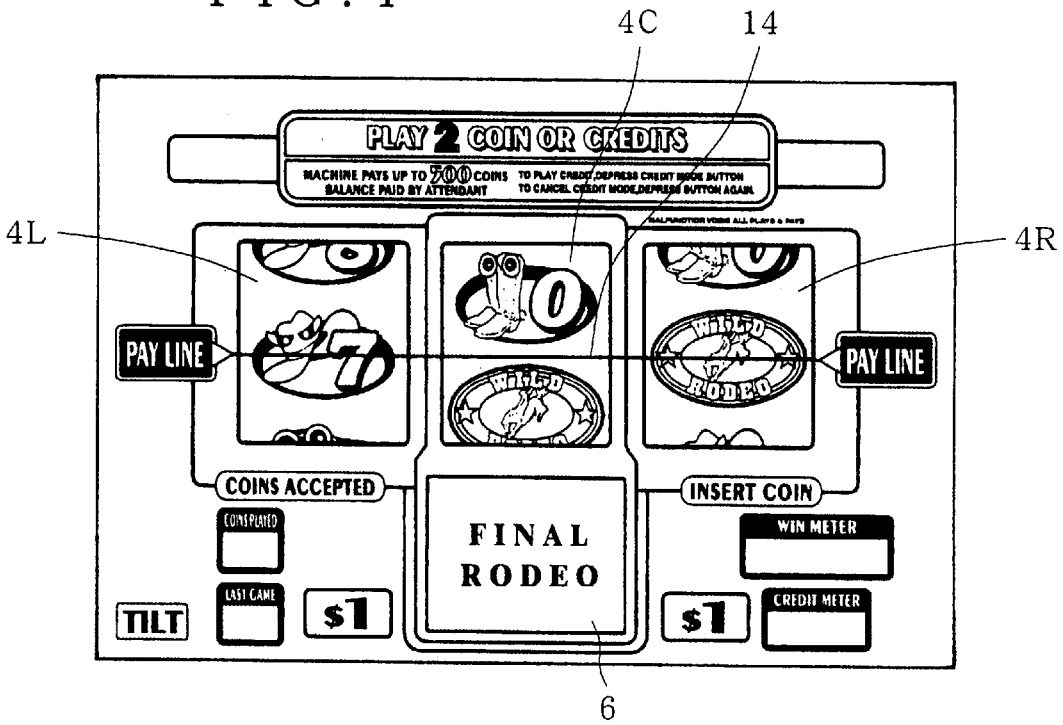
FIG. 4 is a representation that illustrates a display state before the variable display starts and an example of display images of the liquid crystal display of the embodiment of the invention.

In the case where the player is awarded a game that requires no medal insertion by the player, or no medal consumption as a service game or a bonus game, as predictive information of initiation of such a game, there may be displayed an image as shown in FIG. 4 on the screen of liquid crystal display 6 followed by display of successive animation until the game has completed. When such a predictive display is obtained, the player expects initiation of the service game or bonus game on the display image of liquid crystal display 6 and feels rewarded.

Although the illustrative embodiment of the invention described above employs a liquid crystal display as the secondary display, an image display such as CRT, an electric display which is arranged as an indication device of a LED, or a mechanical display such as rotatable display element for selecting an image from among a plurality of such images and to indicate same by stopping rotation, can perform the display function in a manner similar to that of the display image, described hereinabove. It should be noted that the display image that facilitates the recognition of a good game state or a dangerous game state for the player can be effected by non-image indication, such as "on" and "off" (illuminated and non-illuminated) states of a lamp, instead of a character or a picture. Additionally, sounds can be used in addition to, or instead of, the display image. Preferably, the use of sound is made to correspond with a change of the image or the illumination state of an indicator lamp.

In the embodiment described above, liquid crystal display 6 displays the image indicating the control state of the variable display corresponding to a result of an original game. However, in other embodiments the liquid crystal display may display images of other games, i.e., different from the original game. In such an embodiment, ROM 22 of microcomputer 20 would store the data of the display image and the execution program of the different game. In a specific illustrative embodiment of the invention of this multi-game system, CPU 21 executes the operations shown in FIGS. 9 and 10.

Figure 9:
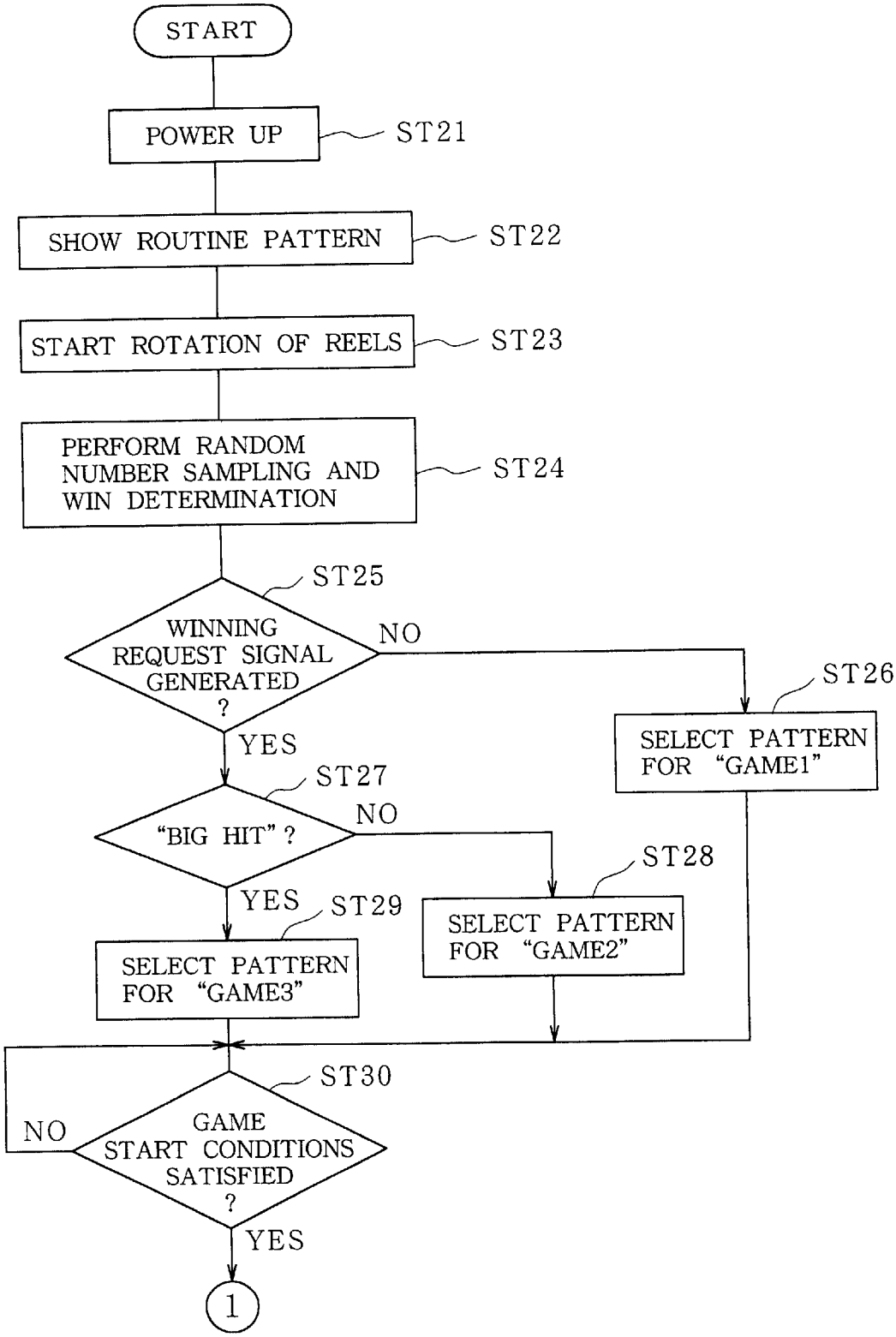
FIG. 9 is a flow chart that illustrates an operation procedure for indicating a separate game presented in the liquid crystal display of an embodiment of this invention.

In FIG. 9, when the gaming machine is powered up (ST21), the CPU operates liquid crystal display 6 to display the "routine pattern" (ST22). When the player has performed necessary operations, such as actuation of start lever 5 or spin switch 8 after insertion of medals into medal inlet 7, or after operation of 1-BET switch 9 or maximum BET switch 10, rotatable display elements 4L, 4C, 4R are rotated to start variable display (ST23). At this time, in response to sampled random number values, win or non-win conditions are determined (ST24). The CPU then determines whether a "winning request signal" has occurred, or not (ST25), and further determines the display mode of the win or of the non-win in response to the result of the judgement. These operations are similar to those shown in FIG. 3.

In the operation of the system of FIG. 9, the image displayed on liquid crystal display 6 is a pattern that corresponds to several games. More specifically, if the "winning request signal" did not occur in the determination of ST25, the CPU selects a pattern for "game 1" (ST26). When the "winning request signal" has occurred, the CPU determines whether or not the "winning request signal" corresponds to the "big hit" (ST27). The CPU then determines a pattern for "game 2" if it is "NO" (ST28), and selects pattern for "game 3" if is "YES" (ST29). Various games can be prepared for game 1", "game 2" and "game 3". For example, for the various games, even if the figures or pictures shown on screen of liquid crystal display 6 are identical, the various games could have respectively different winning probabilities. If the games and the figures or pictures are respectively different for the various games, the winning probabilities would also be respectively different.

Whether a condition to start the game selected as above is satisfied or not is determined (ST30). The starting condition may be an optional condition, for example, the stopping of one rotatable display element (reel), the stopping of two rotatable display elements (reels), or the stopping of all rotatable display elements (reels). The predetermined time permitted for stopping would be predetermined. When the start condition is not "stop of all reels," a game performed by the display of liquid crystal display 6 is started during a rotation of at least one rotatable display element (reel). Consequently, the original game and the separate game on liquid crystal display 6 are played simultaneously.

Figure 10:
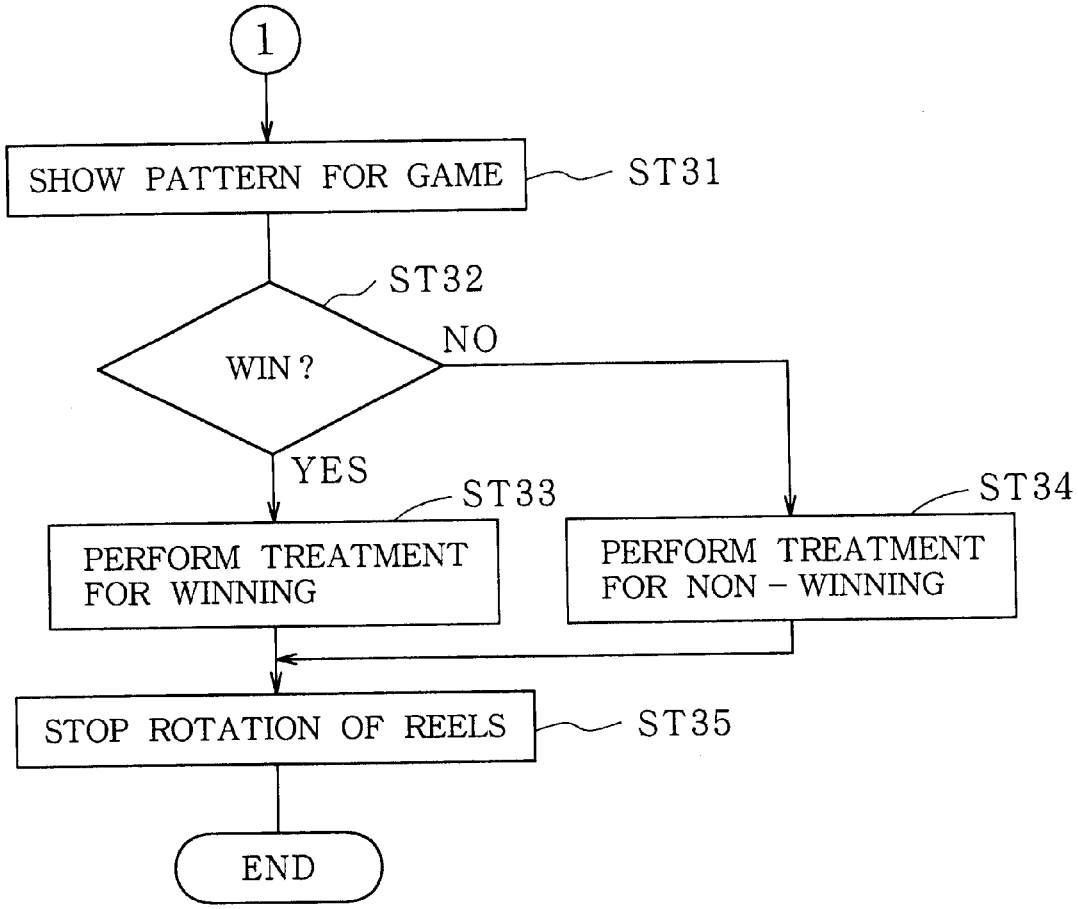
FIG. 10 is a flow chart that is continued from FIG. 9.

When the start conditions are satisfied in the above determination, as shown in FIG. 10, the display of a pattern for a selected game on liquid crystal display 6 is performed (ST31), and thereby the game is played. The win judgment of this game is performed (ST32). Although this win determination may be the win or loss judgement determined by sampled random number values similarly to the original game, a special win judgment may be prepared for this game.

When the operation is determined to be a win, the winning operation is performed (ST33). A specified winning mode is displayed on liquid crystal display 6 and also as mentioned above the same operation as in the case where specified symbols of rotatable display elements 4L, 4C, 4R are arranged on winning line 14 or an individually determined operation may be performed. Alternatively, when the operation is determined to be a non-win, the non-winning operation is performed (ST34). That is, a specified non-winning mode is displayed on the liquid crystal display 6. The stop control is then performed on rotating rotatable display elements 4L, 4C, 4R (ST35). Thus, the non-winning operation is completed.

Figure 11:
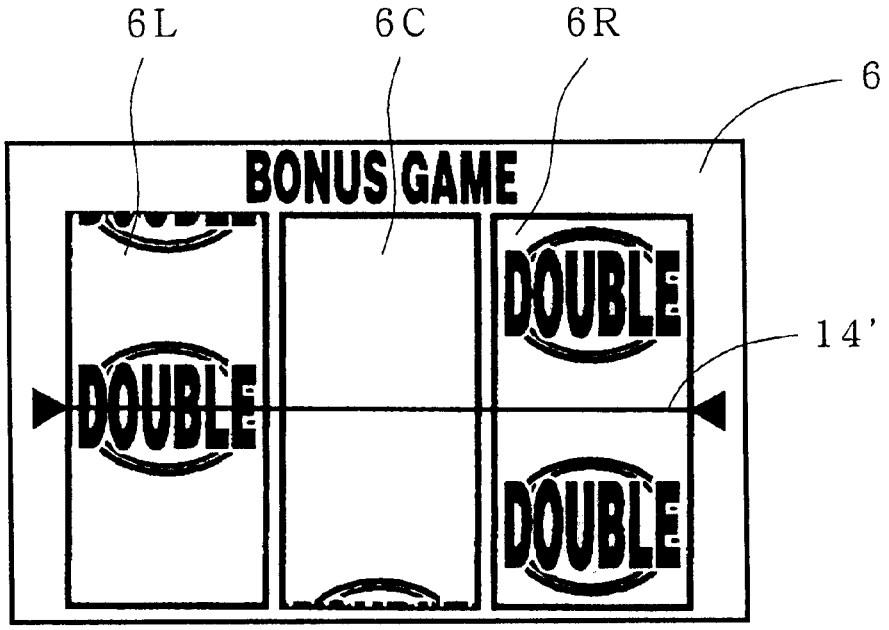
FIG. 11 is a representation that illustrates an example of display images of the separate game performed by the liquid crystal display of the embodiment of this invention.

FIG. 11 shows an example of a display image of a separate game performed on liquid crystal display 6 relating to the game on rotatable display elements 4L, 4C, 4R. In this example, in a fashion similar to the three rotatable display elements 4L, 4C, 4R performing variable display of original game, an image constituting moving three symbol rows 6L, 6C, 6R which performs variable display of a plurality of symbols is displayed on the screen of liquid crystal display 6.

The separate game in this case is prepared as the "bonus game" that is started when stop symbols on winning line 14 at the time of stop of rotation of rotatable display elements 4L, 4C, 4R are arranged in a specified winning mode. At this time a predetermined number of medals is paid to the player as a predetermined award corresponding to the winning mode. Upon the start of the "bonus game," three symbol rows 6L, 6C, 6R are variably displayed on the screen of liquid crystal display 6, and at the time when predetermined period has passed, movement of each symbol row 6L, 6C, 6R stops. When specified symbol "DOUBLE" is positioned on central line 14', a predetermined number of medals are paid to the player once again. Accordingly, the opportunity that an award gained by a win of original game increases into two times in amount is given to the player by the "bonus game."

Further, another example of the separate game is preset such that, in the case of a "lottery game" that is started when at stop of rotation of rotatable display elements 4L, 4C, 4R, stop symbols on the winning line 14 have been arranged in a specified winning mode, without previous determination of distribution of awards for the correspondence to the winning mode, stop symbols (numerals) positioned on the center line 14' upon the stop of variation of three symbol rows 6L, 6C, 6R, similar to the "bonus game" described above, are displayed on the screen of liquid crystal display 6 and express a distribution of awards and medals that are paid in an amount determined in response to a decided distribution of awards.

As described above, information relating to the control state of the variable display in response to the original game or image for separate games is displayed on liquid crystal display 6 as an example of the secondary display of the invention. In addition to these displays, a history of past game results is displayed, illustratively an image that represents the times or frequency of win or loss in games finished in the past. In order to realize the purpose mentioned above, a display change button is provided in a suitable position of the front of the slot machine of FIG. 1 (for example, below the display window), and when the player pushes the display change button at an optional time during the game, the display on the screen of liquid crystal display 6 is switched to the display of times or frequency of win or loss, and when the player pushes the button once again, the display on the screen is returned to the previous state. By the display of past records or history, the player can judge the gaming machine to play whether a hit easily appears or not.

Figure 12:
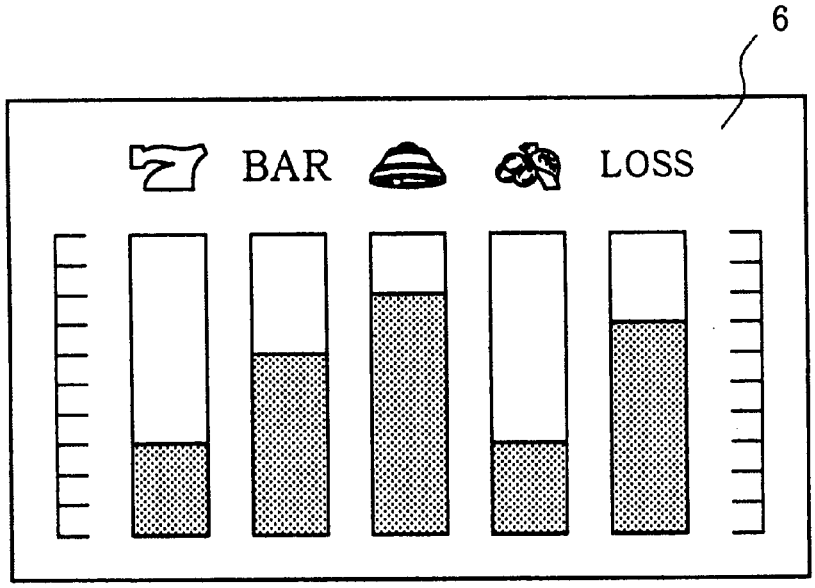
FIG. 12 is a representation that illustrates a state indicating the remaining rate of each symbol by a bar graph on the liquid crystal display of the embodiment of this invention, FIGS. 13(*a–d*) is a representation that illustrates an example of the change of the bar graph display regarding one of the symbols shown in FIG. 12.
Figures 13A, 13B, 13C, 13D:
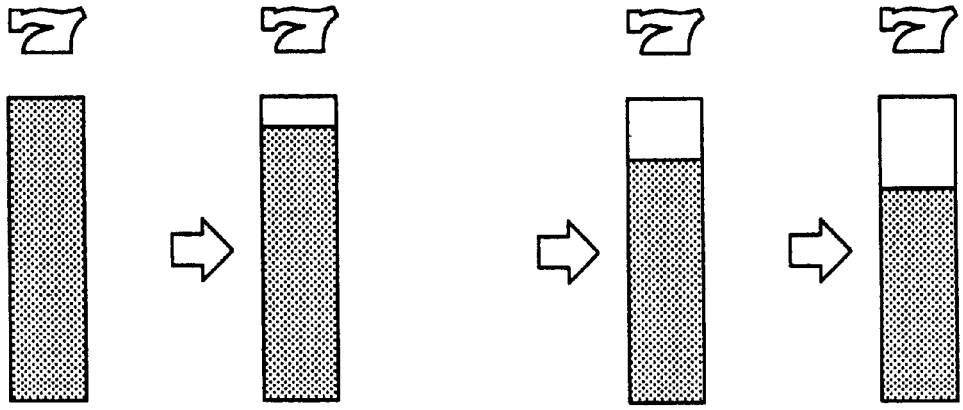
Figures 14, 15:
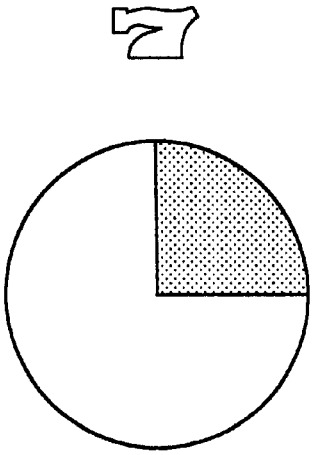
FIG. 14 is a representation that illustrates a case wherein the remaining rate of a symbol is indicated by a circle graph.
FIG. 15 is a representation that illustrates a state indicating the remaining rate of each symbol by numerals on the liquid crystal display of the embodiment of this invention.

As an image showing such a game record or history, for example, the rate of win or loss from the time of activation of the power supply to the gaming machine (for example, frequency or times as a percentage of win or loss assumed to occur by 10,000 times of games) is indicated by analog representation such as by the bar graphs shown in FIGS. 12 and 13, or the circle graph shown in FIG. 14. Also, such data may be shown by digital representation such as with numerals as shown in FIG. 15. The electronic or logical operations for these indications is performed by the microcomputer of slot machine 1 or by the CPU of liquid crystal display 6 itself (if provided).

In the example of FIG. 12, the symbols capable of constituting combinations of win are represented by the "7," the" BAR," the "bell" (a figure), the "cherry" (a figure) and regarding these symbols and the other symbols as a whole (constituting combinations meaning the "loss" of game), each corresponding rate is displayed on the screen of liquid crystal display 6. The bar graph which represents the survival rate (%) of each symbol, as shown in FIG. 13 using symbol "7" as an example, at the time of power supplied or reset of the slot machine 1, represents lighting or a portion indicated brightly in a state of 100% (FIG. 13A) and while a game has been repeated, lighting or a bright portion decreases by 10% (FIGS. 13B to 13D) at each time when the combination of stop symbols at the time of stop of three rotating rotatable display elements 4L, 4C, 4R is arranged to "7—7—7" to generate the "big hit" condition. In the circle graph of FIG. 14, survival rate (%) represented by lighting or emphasis part of each symbol decreases at each time of appearance of big hit. Representations of the other symbols are performed in a manner similar to that described above. In the digital representation of FIG. 15, the numeral representing survival rate (%) of each symbol varies.

Figure 16:
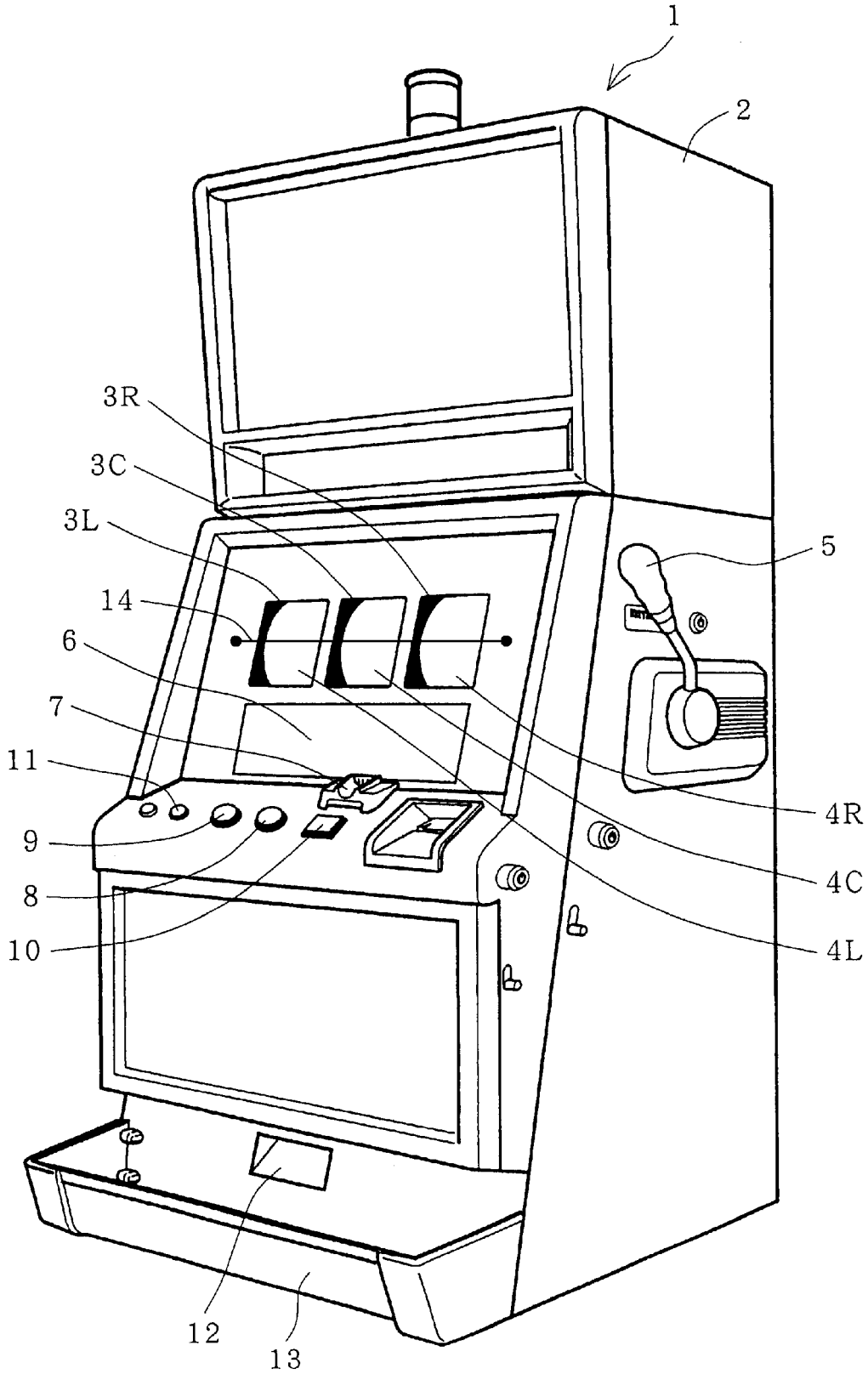
FIG. 16 is an isometric representation of a slot machine of another embodiment of this invention.

Liquid crystal display 6 as an example of a secondary display may be disposed not only below display window 3C in FIG. 1, but also may be configured to occupy the entire area below display windows 3L, 3C, 3R, as shown in FIG. 16. In this embodiment, liquid crystal display 6 can be arranged below left display window 3L, below right display window 3R, or below all three display windows, as shown.

As previously noted, the gaming machine of the present invention may be provided with a variable display having multiple display windows, whereby in each display window three or more symbols would be displayed and several winning lines would be made effective under predetermined conditions.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claim ed is:

1. A gaming machine comprising:

a variable display for displaying principal graphical information corresponding to at least one of a plurality of principal graphical elements, each principal graphical element having a predetermined significance in an ongoing principal game of the gaming machine;

a secondary display for displaying secondary graphical information having a display portion positioned near and below the display portion of said variable display, the secondary graphical information being responsive to the principal graphical information, and having a predetermined relationship to a future result of the ongoing principal game; and a controller for producing first control signals that control said variable display to display the principal graphical information as a sequential progression of the principal graphical elements in the ongoing principal game, and second control signals that control said secondary display to display the secondary graphical information.

2. The gaming machine according to claim 1, wherein said variable display has a plurality of movable display units disposed parallel side-by-side, sad secondary display being provided below the display position of a specified movable display unit that said controller controls to stop last.

3. The gaming machine according to claim 2, wherein the specified movable display unit is disposed at the middle position of said variable display.

4. The gaming machine according to claim 1, wherein said controller determines the secondary graphical information corresponding to the principal graphical information representing the future result of the principal game, and controls the secondary display to display the determined secondary graphical information.

5. The gaming machine according to claim 1, wherein the secondary graphical information has a predetermined meaning in a secondary game by the secondary display, and wherein said controller produces the second control signal in response to the principal graphical information representing the future result of the principal game, selects the specified secondary graphical information corresponding to the second control signals, and controls said secondary display to play the secondary game.

* * * * *